US005974638A

United States Patent [19]

Yamaguchi et al.

[11] Patent Number: 5,974,638

[45] Date of Patent: Nov. 2, 1999

[54] SEAT BELT BUCKLE

[75] Inventors: Yutaka Yamaguchi; Tadayuki Asako; Yoshihiko Kawai, all of Tokyo, Japan

[73] Assignee: Takata Corporation, Tokyo, Japan

[21] Appl. No.: 09/276,120

[22] Filed: Mar. 25, 1999

[30] Foreign Application Priority Data

Mar. 25, 1998 [JP] Japan ..... 10-077605

[51] Int. Cl.[6] ..... A44B 11/26

[52] U.S. Cl. ..... 24/633; 24/641; 24/642

[58] Field of Search ..... 24/633, 634, 642, 24/647, 641, 640; 280/806; 297/468, 378.13

[56] References Cited

U.S. PATENT DOCUMENTS

| | | | |
|---|---|---|---|
| 5,213,365 | 5/1993 | Föhl | 24/633 X |
| 5,496,068 | 3/1996 | Ball et al. | 24/633 X |
| 5,595,400 | 1/1997 | Wier | 24/642 X |
| 5,742,987 | 4/1998 | Mikulec et al. | 24/641 |
| 5,765,266 | 6/1998 | Betz | 24/633 |

*Primary Examiner*—James R. Brittain
*Assistant Examiner*—Robert J. Sandy
*Attorney, Agent, or Firm*—Kanesaka & Takeuchi

[57] ABSTRACT

In a buckle of the present invention, inertia force $F_1$ acts in a direction opposite to a direction toward a disengaging position of a main body 4*d* of a lock member when the buckle is pulled by a pretensioner. Clockwise torque $T_1$ is developed on a lever 12*b* and counter-clockwise torque $T_2$ is developed on a mass body 12*c*. Since the torque $T_2$ of the mass body 12*c* is larger generally, the lever 12*b* and the mass body 12*c* rotate together in the counter-clockwise direction so that the lever is set in the restricting position. At the bottoming of the pulling action of the buckle, the inertia force $F_2$ acts in a direction toward the disengaging position of the main body 4*d*. Therefore, the mass body 12*c* rotates in the clockwise direction and the lever 12*b* is held in the restricting position so that the movement of the lock member in the direction toward the disengaging position of the main body 4*d* is prevented. As a result of this, unexpected disengagement between the buckle and the tongue is prevented even with extreme acceleration, the operational feeling of an operational button is improved, interchangeability is provided to the operational button, and the assembly condition of components such as the operational button is improved.

3 Claims, 12 Drawing Sheets

SEAT BELT BUCKLE

BACKGROUND OF THE INVENTION

The present invention pertains to a technical field of a seat belt device for restraining an occupant which is provided for a seat of a vehicle such as an automobile. More particularly, the present invention pertains to a technical field of a buckle on which extreme inertia force is exerted by, for example, pulling action by a pre-tensioner when a seat belt device restraints an occupant.

Nowadays, in various vehicles including automobiles, seat belt devices for protecting occupants in emergency such as collision are mounted for seats thereof. In order to facilitate the occupant to wear on and off such a seat belt, a buckle is normally provided. In general, the buckle comprises a latch member provided with a joggle portion which latches a tongue. The engagement and disengagement between the tongue and the buckle are achieved by that the latch member is biased by a spring in such a direction as to latch the tongue and by that the latch member is pivoted by an operational button in such a direction as to release the tongue.

A buckle of a type that is pulled by a pre-tensioner when the seat belt restraints an occupant is known in the art. The buckle of this type is rapidly pulled by the pre-tensioner so as to cause extreme acceleration. Because of this acceleration, inertia force is developed in a direction opposite to the direction of the acceleration. Due to the inertia force, there is a possibility of unexpected disengagement between the tongue and the buckle.

Therefore, a buckle for a safety belt has been proposed in Japanese Patent Unexamined Publication No. 08-228809, which can securely prevent such unexpected disengagement between a tongue and the buckle even when the buckle is subjected to extreme acceleration.

In the buckle disclosed in this publication, a release button has a pair of limit stops spaced from each other with a predetermined distance and, on the other hand, a lever has a pair of first and second lever arms, which are formed integrally with each other, and a mass body. The first and second lever arms and the mass body are disposed on a frame in such a manner that they can rotate together. The first lever arm is located to confront one of the limit stops of the release button and the second lever arm is located to confront the other one of the limit stops.

In case of normal releasing operation of the release button, one limit stop strikes the first lever arm and pivots the first and second lever arms and the mass body while the release button moves in a direction of disengaging the tongue from buckle. As extreme acceleration is exerted on the buckle in a direction opposite to the disengaging direction of the release button, inertia force in the disengaging direction of the release button is developed on the release button, the first and second lever arms, and the mass body, so the first and second lever arms and the mass body are pivoted whereby the first lever arm is brought in contact with one of the limit stops. Since the release button is therefore prevented from moving in the disengaging direction, the disengagement between the tongue and the buckle is prevented. As extreme acceleration is exerted on the buckle in the disengaging direction of the release button, inertia force in the direction opposite to the disengaging direction of the release button is developed on the release button, the first and second lever arms, and the mass body, so the first and second lever arms are pivoted whereby the second lever arm is brought in contact with the other limit stop. This prevents the release button from moving in the direction opposite to the disengaging direction.

In the buckle disclosed in the publication, unexpected disengagement between the tongue and the buckle during extreme acceleration or deceleration can be securely prevented.

In case that the buckle is pulled by the pre-tensioner, the terminal of this pulling action causes acceleration in a direction opposite to that of the acceleration developed during the pulling action. This acceleration exerts inertia force on the buckle in the direction opposite to that of the acceleration. That is, there is a possibility that the direction of inertia force is suddenly reversed at the termination of the pulling action by the pre-tensioner. Such sudden reversion may cause unexpected disengagement between the tongue and the buckle.

In the buckle disclosed in the aforementioned publication, however, since the first and second lever arms and the mass body are formed integrally with each other, the inertia moment must be large. Therefore, it is quite difficult to reverse the direction of the lever which is pivoted. Accordingly, it should be difficult to securely correspond such sudden reversion of the direction of the inertia force to prevent the unexpected disengagement between the tongue and the buckle.

Since the first and second lever arm and the mass body are pivoted together during the movement of the release button in the disengaging direction, larger operating force is required as compared to a case where only the release button is moved, so it is hard to say that the operational feeling of the buckle is excellent without any problem.

Further, the limit stops of the release button make the release button's configuration special so that the release button does not have interchangeability with release buttons of other buckles. The first and second lever arms are disposed on a frame separate from the release button while the limit stops are disposed on the release button. In order to secure the operation of the limit stops and the first and second lever arms, the spaces among them should be exactly set, so it is hard to say that the assembly condition of the release button, the first and second lever arms is excellent.

SUMMARY OF THE INVENTION

It is an object of the present invention to provide a buckle which can prevent unexpected disengagement between the buckle and the tongue even with sudden change of the direction of acceleration. In addition, the operational member of the buckle is improved in its operational feeling and has interchangeability relative to other buckles, and the buckle is improved in its assembly condition of components.

To accomplish this object, in a buckle comprising: a base having side walls; a latch member which is supported by the side walls so that the latch member can pivot between its non-engaged position and its engaged position, is biased to the engaged position, and pivots to the engaged position, when a tongue is inserted into a predetermined position, so as to engage the tongue; an operational member for canceling the engagement between the tongue and the latch member; and a lock member which holds the latch member to the engaged position when the tongue and the latch member are engaged with each other and is able to be moved by the operational member to a position allowing the disengagement between the tongue and the latch member; the present invention is characterized by further comprising an inhibiting means for preventing the movement of the lock member toward the position allowing the disengagement not caused by the releasing action of the operational member, and is characterized in that the inhibiting means has first and second inertia bodies of which masses are different from each other and which can rotate about a common shaft allowing relative rotation and are subjected to respective torque acting in directions opposite to each other when external force is exerted on the buckle; and that the first inertia body can rotate between a restricting position preventing the movement of the lock member toward the position allowing the disengagement not caused by the releasing action of the operational member and a non-restricting position allowing the movement of the lock member toward the position allowing the disengagement, and is normally set in the non-restricting position and is designed such that torque is developed to rotate the first inertia body in a direction from the non-restricting position to the restricting position when inertia force causing the movement of the lock member toward the position allowing the disengagement is exerted, and the second inertia body, at least, rotates from the original position to the position where the first inertia body is set in the restricting position when inertia force exceeding a predetermined value acts in the direction opposite to the travel direction of the lock member toward the position allowing the disengagement of the lock member, and then rotates toward the original position when inertia force acts in the travel direction of the lock member toward the position allowing the disengagement.

The present invention is characterized in that the lock member is arranged to be allowed to move only in the longitudinal direction of the buckle.

In addition, in a buckle comprising: a base having side walls; a latch member which is supported by the side walls so that the latch member can pivot between its non-engaged position and its engaged position, is biased to the engaged position, and pivots to the engaged position, when a tongue is inserted into a predetermined position, so as to engage the tongue; and an operational member capable of moving to a disengagement position where the engagement between the tongue and the latch member is canceled; the present invention is characterized by further comprising an inhibiting means for preventing the movement toward a disengagement position not caused by the releasing action of the operational member, wherein the inhibiting means has first and second inertia bodies of which masses are different from each other and which can rotate about a common shaft allowing relative rotation and are subjected to respective torque acting in directions opposite to each other when external force is exerted on the buckle; and characterized in that the first inertia body can rotate between a restricting position preventing the movement toward the disengagement position not caused by the releasing action of the operational member and a non-restricting position allowing the movement toward the disengagement position, and is normally set in the non-restricting position and is designed such that torque in a direction from the non-restricting position to the restricting position is developed when inertia force causing the movement of the lock member toward the disengagement position is exerted, and the second inertia body, at least, rotates from the original position to the position where the first inertia body is set in the restricting position when inertia force exceeding a predetermined value acts in the direction opposite to the travel direction of the operational member toward the disengagement position, and rotate toward the original position when inertia force acts in the travel direction of the operational member toward the disengagement position.

In the buckle according to the present invention as structured above, when inertia force acts to cause the movement of the lock member toward the position allowing the disengagement, the first inertia body rotates to the restricting position. Therefore, the lock member is prevented from moving to the position allowing the disengagement, thereby securely preventing unexpected disengagement between the buckle and the tongue.

When inertia force exceeding a predetermined value acts in the direction opposite to the travel direction of the lock member toward the position allowing the disengagement, the second inertia body rotates to the position where the first inertia body is set in the restricting position. When inertia force suddenly acts in the travel direction of the lock member toward the position allowing the disengagement just after the termination of acting of the inertia force in the direction opposite to the travel direction of the lock member toward the position allowing the disengagement, the first inertia body is held in the restricting position because of torque acting in the direction of holding the first inertia body in the restricting position and the second inertia body rotates toward the original position. The rotation of the second inertia body does not effect the holding of the first inertia body in the restricting position. Accordingly, even when the direction of the inertia force is suddenly changed from the direction opposite to the direction toward the position allowing the disengagement to the direction toward the position allowing the disengagement, the lock member is securely prevented from moving toward the position allowing the disengagement so that the unexpected disengagement between the buckle and the tongue can be securely prevented.

Therefore, when the buckle is suddenly pulled for example by the actuation of the pre-tensioner, extreme inertia force is suddenly exerted on the lock member in the direction opposite to the direction allowing the disengagement during the start of the actuation of the pre-tensioner to just before the bottoming, so that the second inertia body sets the first inertia body in the restricting position. After that, even when extreme inertia force is suddenly exerted in the direction toward the position allowing the disengagement at the bottoming of the pulling action of the pre-tensioner, the unexpected disengagement between the buckle and the tongue can be securely prevented because the first inertia body is held in the restricting position.

Since the movement of the operational member is not restricted by the inhibiting means, the operational feeling of the operational member is still well even with the inhibiting means. The operational member is not formed with a special part, thereby providing interchangeability to the operational member. The inhibiting means and the related components are not required to be assembled with quite high accuracy, thereby improving the assembly condition of the parts including the operational button.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

Figure 1A:
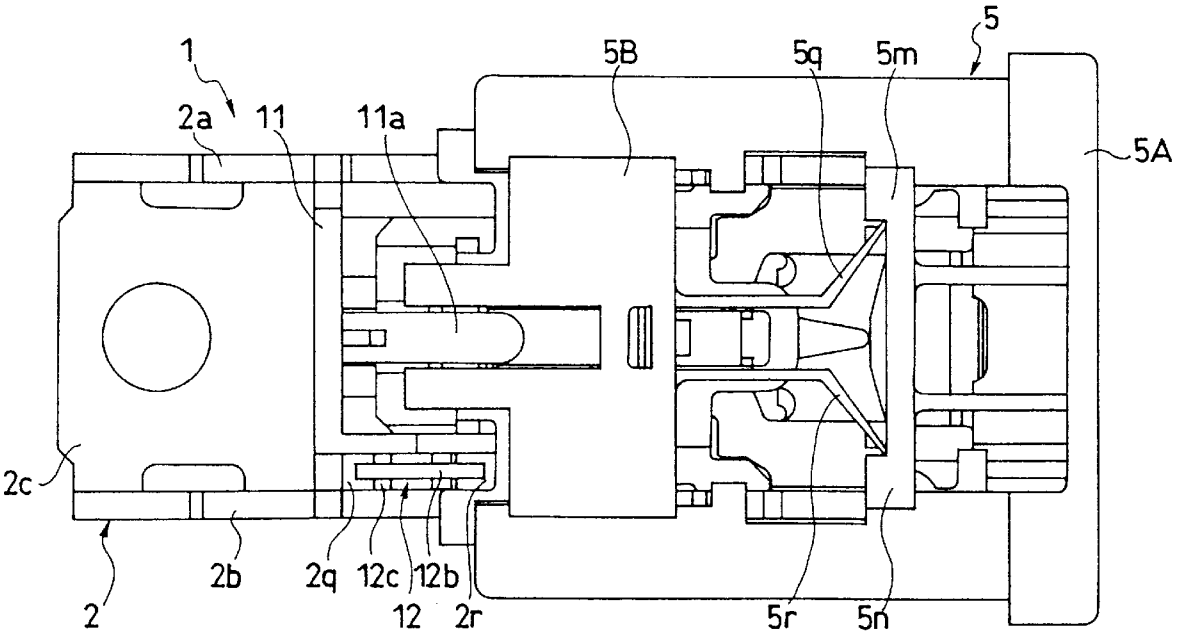
FIG. 1(*a*) is a plane view showing a buckle according to an embodiment of the present invention and FIG. 1(*b*) is a partial sectional view showing the buckle in its non-engaged state with a tongue.
Figure 1B:
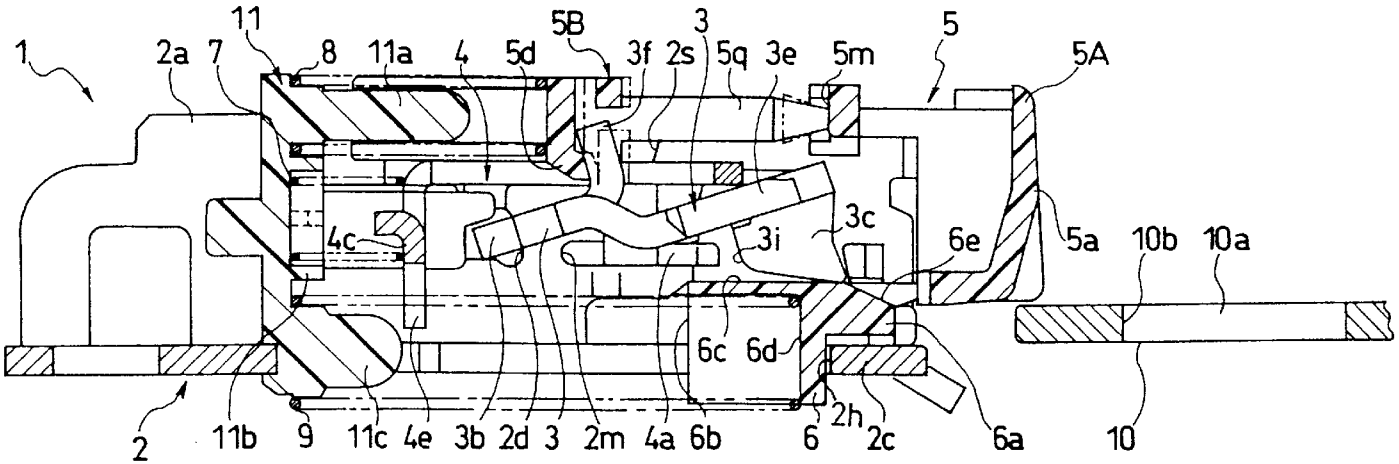
Figure 2:
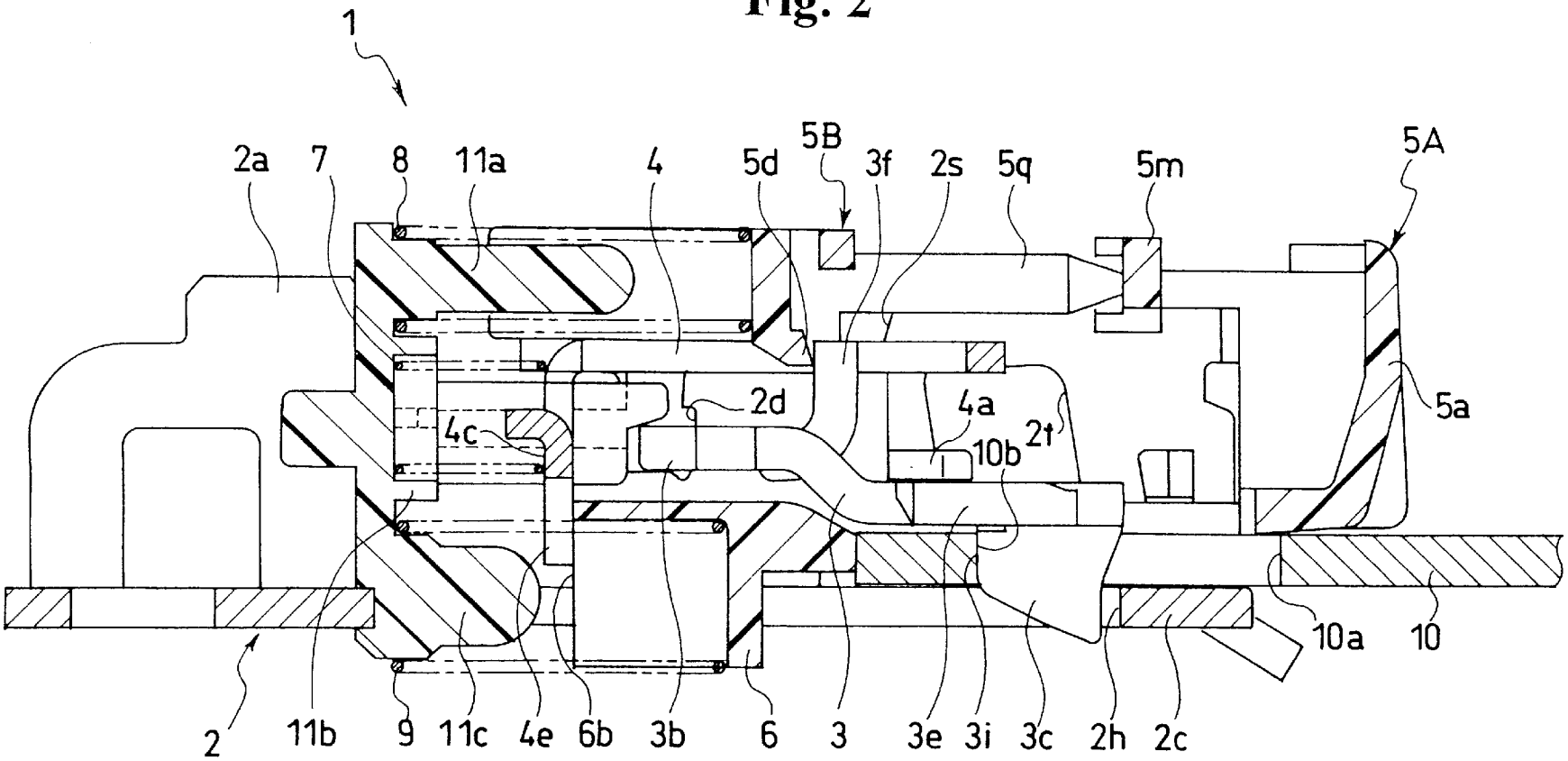
FIG. 2 is a partial sectional view showing the buckle of the embodiment shown in FIGS. 1(*a*), 1(*b*) in its engaged state with the tongue.

FIG. 1(*a*) is a plane view showing a buckle according to an embodiment of the present invention and FIG. 1(*b*) is a partial sectional view the buckle in its non-engaged state with a tongue; FIG. 2 is a partial sectional view showing the buckle in its engaged state with the tongue. It should be noted that "right", "left", "up", and "down" in the following description represent the right, left, up, and down in the attached drawings.

As shown in FIG. 1(*a*) and FIG. 1(*b*), the buckle 1 of the first embodiment comprises a base 2 which is a U-like frame having side walls 2*a*, 2*b* and a bottom 2*c*, a latch member 3 pivotally supported by the side walls 2*a*, 2*b* of the base 2, a lock slider 4 disposed to the side walls 2*a*, 2*b* of the base 2 in such a manner that the lock slider 4 can move linearly in the longitudinal direction (right-left direction) of the buckle 1, an operational button 5 disposed to the side walls 2*a*, 2*b* in such a manner that the operational button 5 can move linearly in the right-left direction, an ejector 6 slidably disposed on the bottom 2*c* of the base 2, a slider spring 7 always biasing the lock slider 4, a button spring 8 always biasing the operational button 5, and an ejector spring 9 always biasing the ejector 6.

Figure 3A:
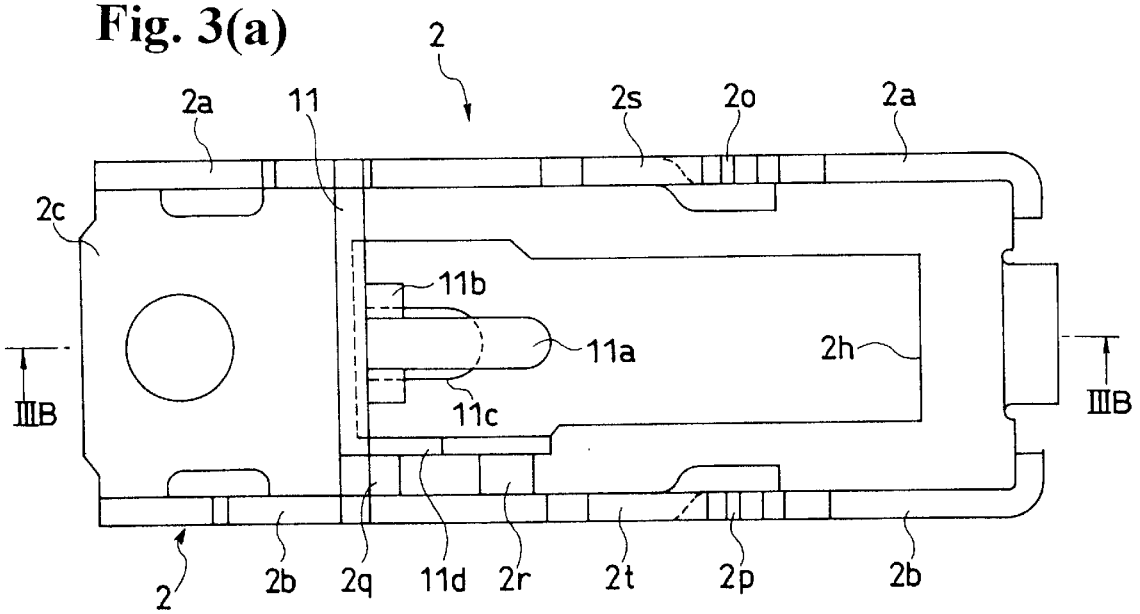
FIG. 3 (*a*) is a plan view showing a base employed in the buckle of the embodiment shown in FIGS. 1(*a*), 1(*b*) and FIG. 3(*b*) is a sectional view taken along a line IIIB—IIIB of FIG. 3(*a*)
Figure 3B:
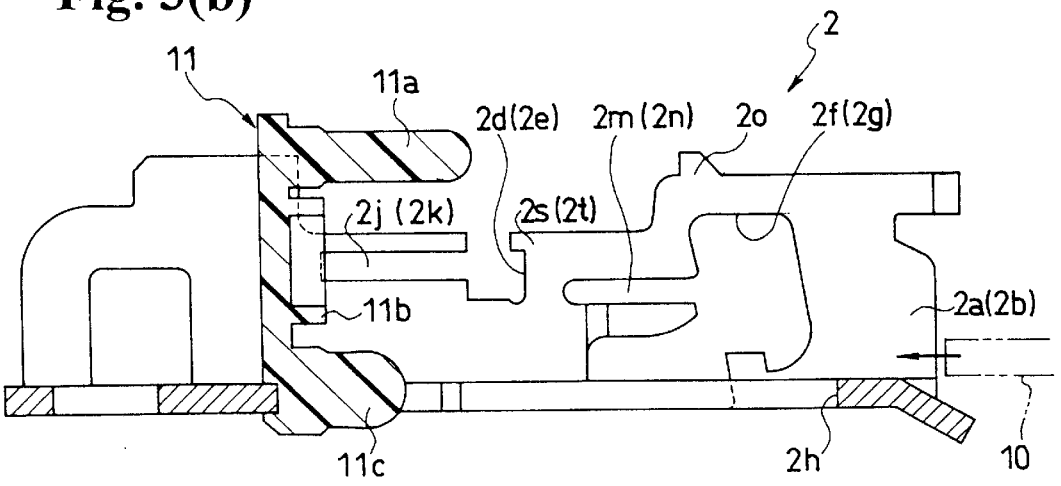

As shown in FIGS. 3(*a*) and 3(*b*), the side walls 2*a*, 2*b* of the base 2 have shaft holes 2*d*, 2*e* (in FIG. 3(*b*), since only one side wall 2*a* is illustrated, the numeral 2*e* of the shaft hole formed in the other side wall 2*b* is shown in parenthesis. Hereinafter, the same is true for other numerals.) and fan-shaped openings 2*f*, 2*g* formed therein, respectively. The shaft hole 2*d* and the fan-shaped opening 2*f* formed in one side wall 2*a*, and, the shaft hole 2*e* and the fan-shaped opening 2*g* formed in the other side wall 2*b* are positioned symmetrically about the longitudinal axis. The bottom 2*c* of the base 2 is provided with an elongated opening 2*h* formed in the center thereof.

The side walls 2*a*, 2*b* have grooves 2*s*, 2*t* formed at the upper ends thereof in the right-left direction. The side walls 2*a*, 2*b* have first operational piece guide holes 2*j*, 2*k* continued from the shaft holes 2*d*, 2*e* and extending in the right-left direction. The side walls 2*a*, 2*b* also have restraining portion guide holes 2*m*, 2*n* continued from the fan-shaped openings 2*f*, 2*g* and extending in the longitudinal direction. Moreover, the side walls 2*a*, 2*b* are provided with stopper projections 2*o*, 2*p*, respectively.

First and second stoppers 2*q*, 2*r* are disposed to project from the bottom 2*c* so that the stoppers 2*q*, 2*r* are spaced apart from each other at a predetermined distance in the right-left direction.

Secured to an end portion of the base 2 where is opposite to the end through which the tongue 10 is inserted is a spring holder 11 supporting the respective one ends of the springs 7, 8, 9. In this case, a first spring guide 11*a* for guiding the button spring 8, a second spring guide 11*b* for guiding the slider spring 7, and a third spring guide 11*c* for guiding the ejector spring 9 are disposed in an upper position, an almost middle position, a lower position of the elongated opening 2*h*, respectively.

The spring holder 11 has a supporting wall 11*d* extending parallel with the side wall 2*b* and being spaced apart form the side wall 2*b* at a predetermined distance. The supporting wall 11*d* may be disposed to project from the bottom 2*c* of the base 2.

Figure 4:
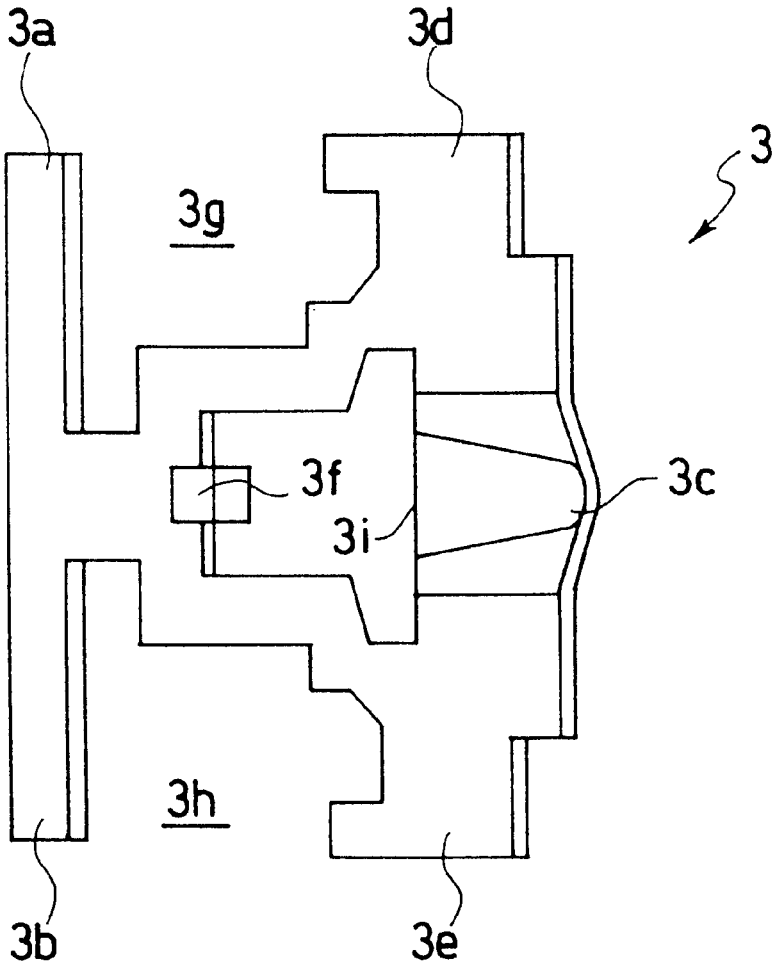
FIG. 4(*a*) is a plan view showing a lock slider employed in the buckle of the embodiment shown in FIGS. 1(*a*), 1(*b*) and FIG. 4(*b*) is a front view thereof.
Figure 4B:
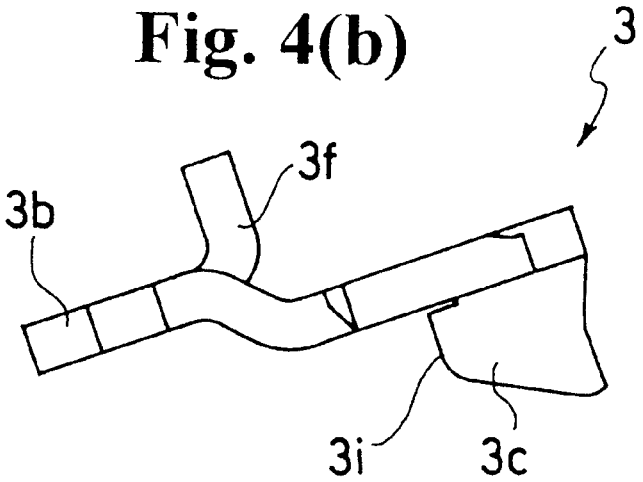

As shown in FIGS. 4(*a*) and 4(*b*), the latch member 3 is formed symmetrically about the longitudinal axis and comprises shafts 3*a*, 3*b* inserted in and supported by the shaft holes 2*d*, 2*e* of the side walls 2*a*, 2*b*, a joggle portion 3*c* having a latch end 3*c* which can be latched to a latch end 10*b* of a latch hole 10*a* of the tongue 10, shoulder portions 3*d*, 3*e* movable within the fan-shaped openings 2*f*, 2*g* and capable of being supported by the lock slider 6, and a pressed portion 3*f* capable of coming in contact with the operational button 5.

That is, the latch member 3 can pivot about the shafts 3*a*, 3*b* between an upper or non-engaged position shown in FIG. 1(*b*) where the joggle portion 3*c* is not latched to the latch hole 10*a* of the tongue 10 and a lower or engaged position shown in FIG. 2 where the joggle portion 3*c* is latched to the latch hole 10*a*.

The latch member 3 is provided with concave portions 3*g*, 3*h* formed between the shafts 3*a*, 3*b* and the shoulder portions 3*d*, 3*e*, respectively.

Figure 5A:
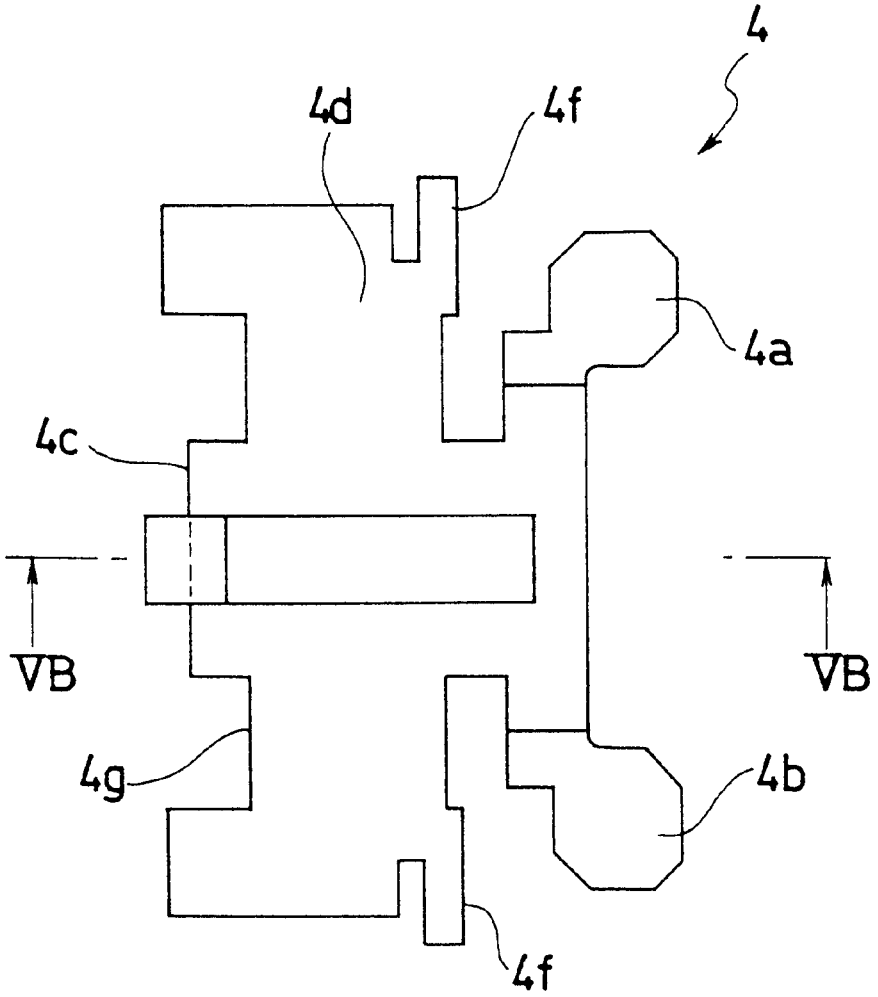
FIG. 5(*a*) is a plan view showing a lock slider employed in the buckle of the embodiment shown in FIGS. 1(*a*), 1(*b*) and FIG. 5(*b*) is a side view thereof.
Figure 5B:
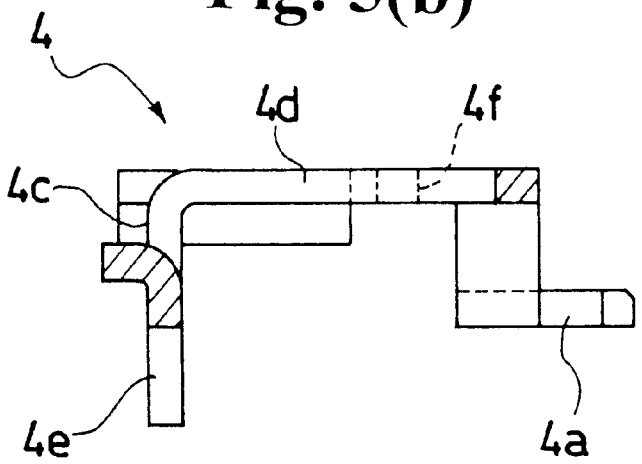

As shown in FIGS. 5(*a*) and 5(*b*), the lock slider 4 is formed symmetrically about the longitudinal axis and comprises supporting/restraining portions 4*a*, 4*b* which hold the latch member 3 in the non-engaged position to secure the passage for the tongue 10 by supporting the shoulder portions 3*d*, 3*e* of the latch member 3 until the tongue 10 is inserted and reaches a predetermined position where the tongue 10 can latch the latch member 3 and which hold the latch member 3 in the engaged position to prevent the disengagement between the latch member 3 and the tongue 10 by restraining the shoulder portions 3*d*, 3*e* of the latch member 3, a spring supporting portion 4*c* which is located at a position confronting the second spring guide 11*b* of the spring holder 11 to support the other end of the slider spring 7, a main body 4*d* which connects the supporting/restraining portions 4*a*, 4*b* and the spring supporting portion 4*c* and is supported by the side walls 2*a*, 2*b* slidably along longitudinal grooves 2*s*, 2*t*, an ejector-contact portion 4*e* which is able to be in contact with and is pressed by the ejector 6, pressed portions 4*f*, and a lever-contact portion 4*g*.

The supporting/restraining portions 4*a*, 4*b* are fitted in the restraining portion guide holes 2*m*, 2*n* and guided to slide along the restraining portion guide holes 2*m*, 2*n*.

That is, the lock slider 4 is movable only in the longitudinal direction of the buckle 1 and is always biased by the spring force of the slider spring 7 in such a direction (rightward in FIG. 1(*b*)) that the supporting/restraining portions 4*a*, 4*b* become closer to the shoulder portions 3*d*, 3*e* of the latch member 3.

Figure 6A:
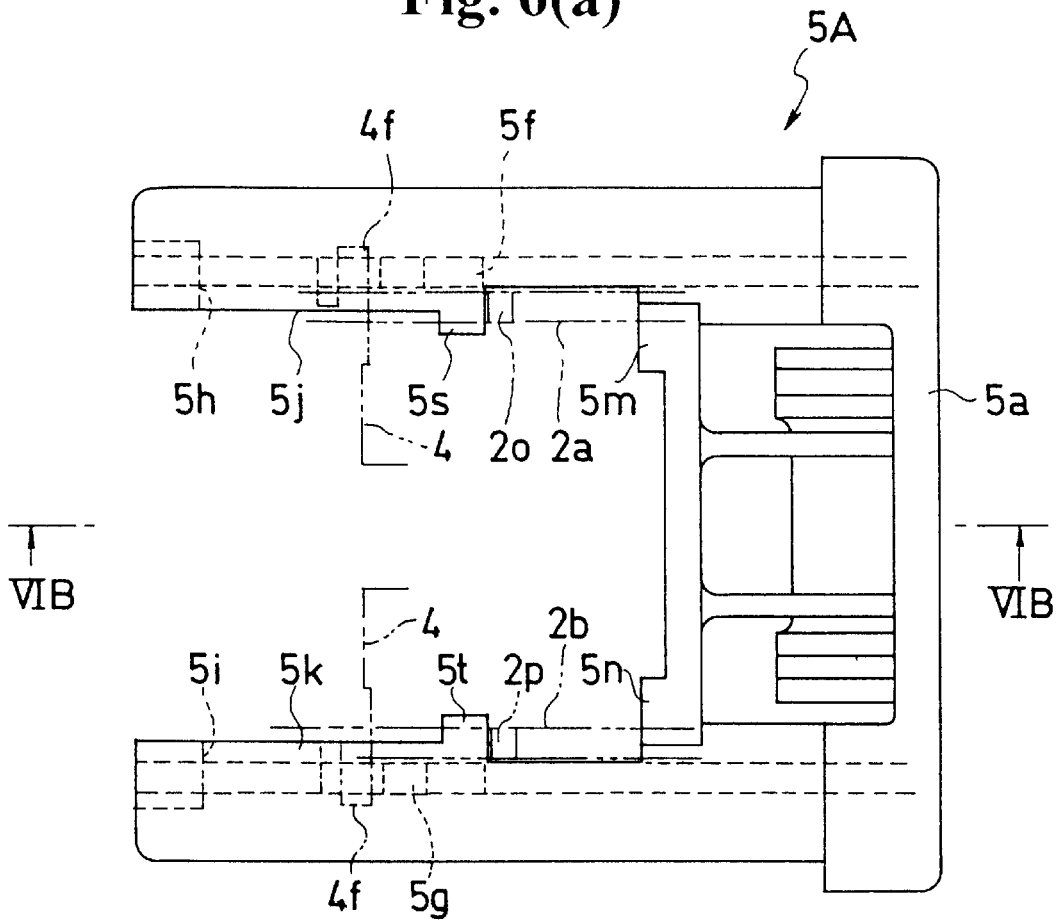
FIG. 6(*a*) is a plan view showing a first operational piece employed in the buckle of the embodiment shown in FIGS. 1(*a*), 1(*b*), FIG. 6(*b*) is a sectional view taken along a line VIB—VIB of FIG. 6(*a*), and FIG. 6(*c*) is a view taken in a direction VIC of FIG. 6(*b*), FIG. 7(*a*) is a plan view showing a second operational piece employed in the buckle of the embodiment shown in FIGS. 1(*a*), 1(*b*), FIG. 7(*b*) is a sectional view taken along a line VIIB—VIIB of FIG. 7(*a*), and FIG. 7(*c*) is a sectional view along a line VIIC—VIIC of FIG. 7(*a*), FIG. 8(*a*) is a plan view showing an ejector employed in the buckle of the embodiment shown in FIGS. 1(*a*), 1(*b*), FIG. 8(*b*) is a side view thereof with a portion being cut out, and FIG. 8(*c*) is a front view thereof.
Figure 6B:
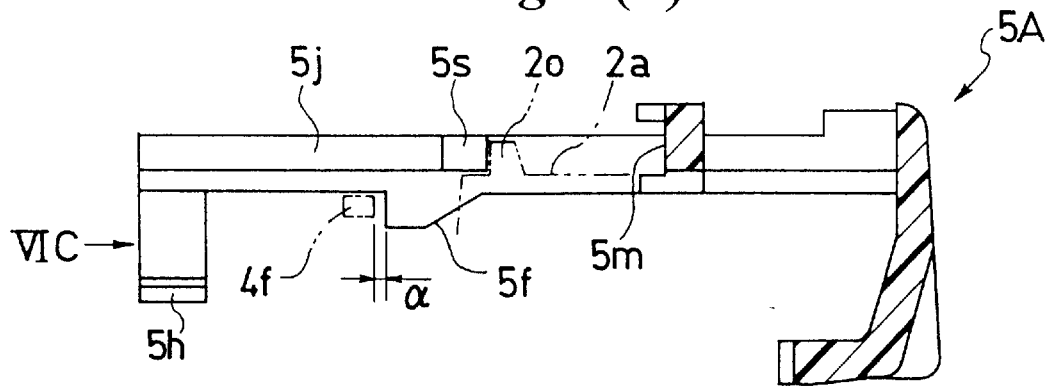
Figure 6C:
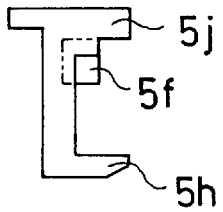

As shown in FIG. 1(*a*), the operational button 5 comprises two pieces: a first operational piece 5A and a second operational piece 5B. As shown in FIGS. 6(*a*) and 6(*b*), the first operational piece 5A is formed symmetrically about the longitudinal axis and is disposed on the side walls 2*a*, 2*b* of the base 2 in such a manner that the first operational piece 5A is slidable along the side walls 2*a*, 2*b* in the longitudinal direction of the buckle 1. The first operational piece 5A is provided with an operational portion 5*a* which the seat belt user directly touches, slider press portions 5*f*, 5*g* which are able to be in contact with the pressed portions 4*f*, 4*f* of the lock slider 4 and press and move the lock slider 4, and guides 5*h*, 5*i* which are fitted in the first operational piece guide holes 2*j*, 2*k* to guide the first operational piece 5A so that the first operational piece 5A can slide in the right-left direction.

The first operational piece 5A is also provided with guide rails 5*j*, 5*k* for guiding the second operational piece 5B and spring supporting portions 5*m*, 5*n* capable of supporting springs (described later) which are disposed on the second operational piece 5B. The first operational piece 5A is further provided with stoppers 5*s*, 5*t*, and as shown in FIGS. 6(*a*), 6(*b*), the stoppers 5*s*, 5*t* come in contact with stopper projections 2*o*, 2*p* (shown by chain double-dashed lines in FIGS. 6(*a*), 6(*b*)) of the side walls 2*a*, 2*b* of the base 2, thereby preventing the first operational piece 5A from moving rightward from the inoperative position shown in FIG. 1(*b*).

Figure 7A:
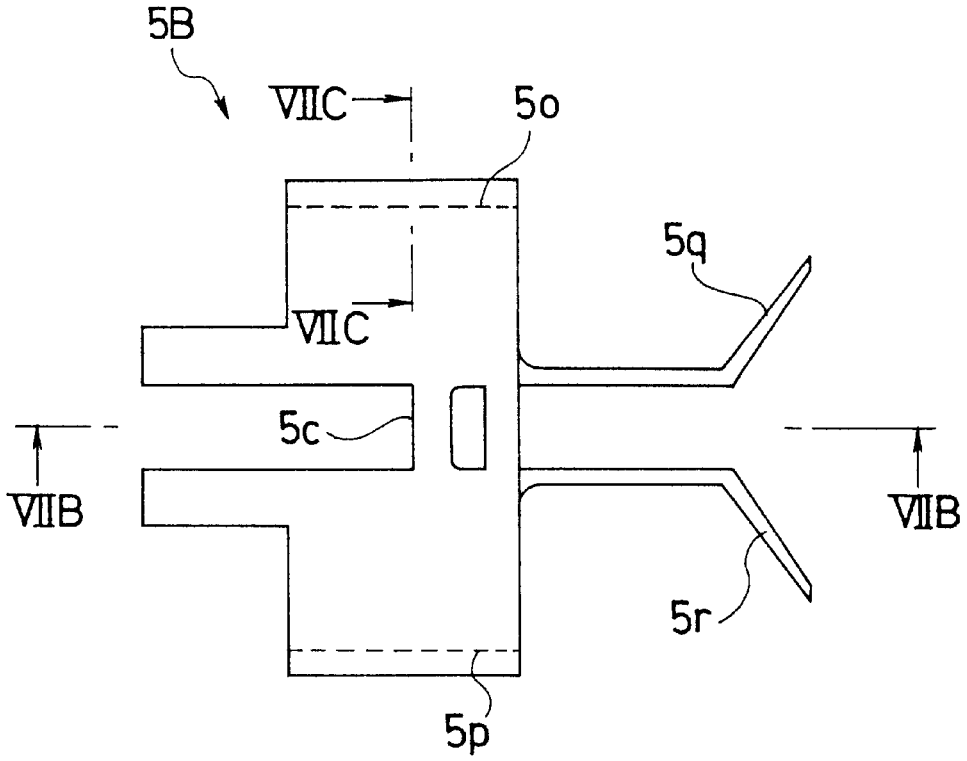
Figure 7B:
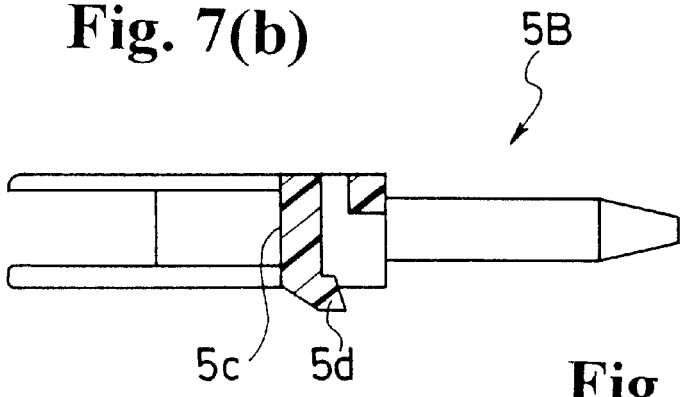
Figure 7C:
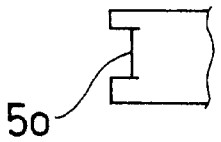

As shown in FIGS. 7(*a*) and 7(*b*), the second operational piece 5B is formed symmetrically about the longitudinal axis and is disposed in such a manner that the second operational piece 5B is able to slide along the guide rails 5*j*, 5*k* relative to the first operational piece 5A. The second operational piece 5B comprises a spring supporting member 5*c* which supports the other end of the button spring 8 and a latch member press portion 5*d* which presses a pressed portion 3*f* of the latch member 3. The second operational piece 5B is also provided with guide grooves 5*o*, 5*p* which fit to the guide rails 5*j*, 5*k* of the first operational piece 5A, respectively. Therefore, the second operational piece 5B is always biased rightward in FIG. 1(*b*) by the spring force of the button spring 8.

The second operational piece 5B has spring guide supporting portions 5*q*, 5*r* formed integrally therewith, which are positioned to confront the spring guide supporting portions 5*m*, 5*n* of the first operational piece 5A. Between the first and second operational pieces 5A, 5B, two springs 12, 13 are compressed and supported between the spring guide supporting portions 5*m*, 5*n* and 5*q*, 5*r*. When the second operational piece 5B moves rightward relative to the first operational piece 5A in FIGS. 1(*a*), 1(*b*), the springs 12, 13 are elastically deformed whereby the sliding movement of the second operational piece 5B is absorbed so as not to change the location of the first operational piece 5A. That is, even when the second operational piece 5B moves relative to the first operational piece 5A, the first operational piece 5A does not move.

Figure 8A:
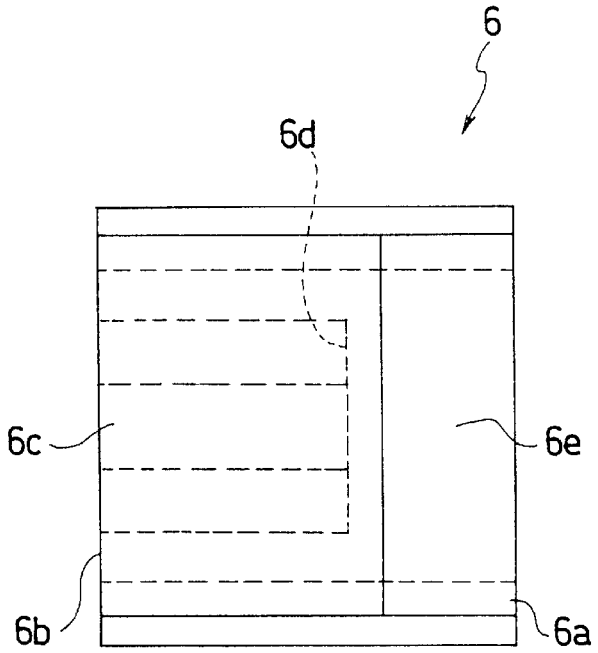
Figure 8B:
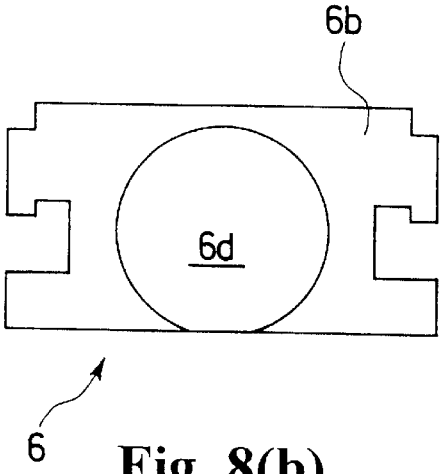
Figure 8C:
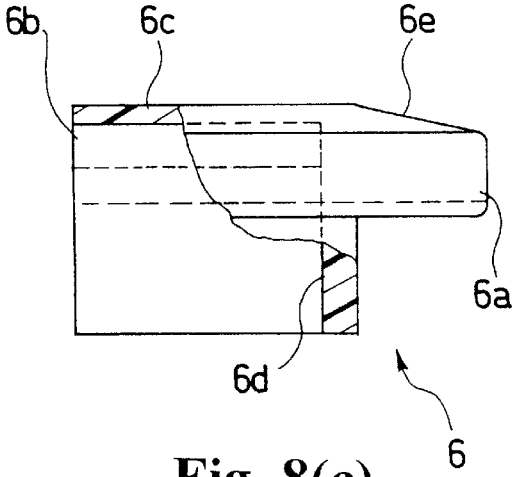
Figure 9:
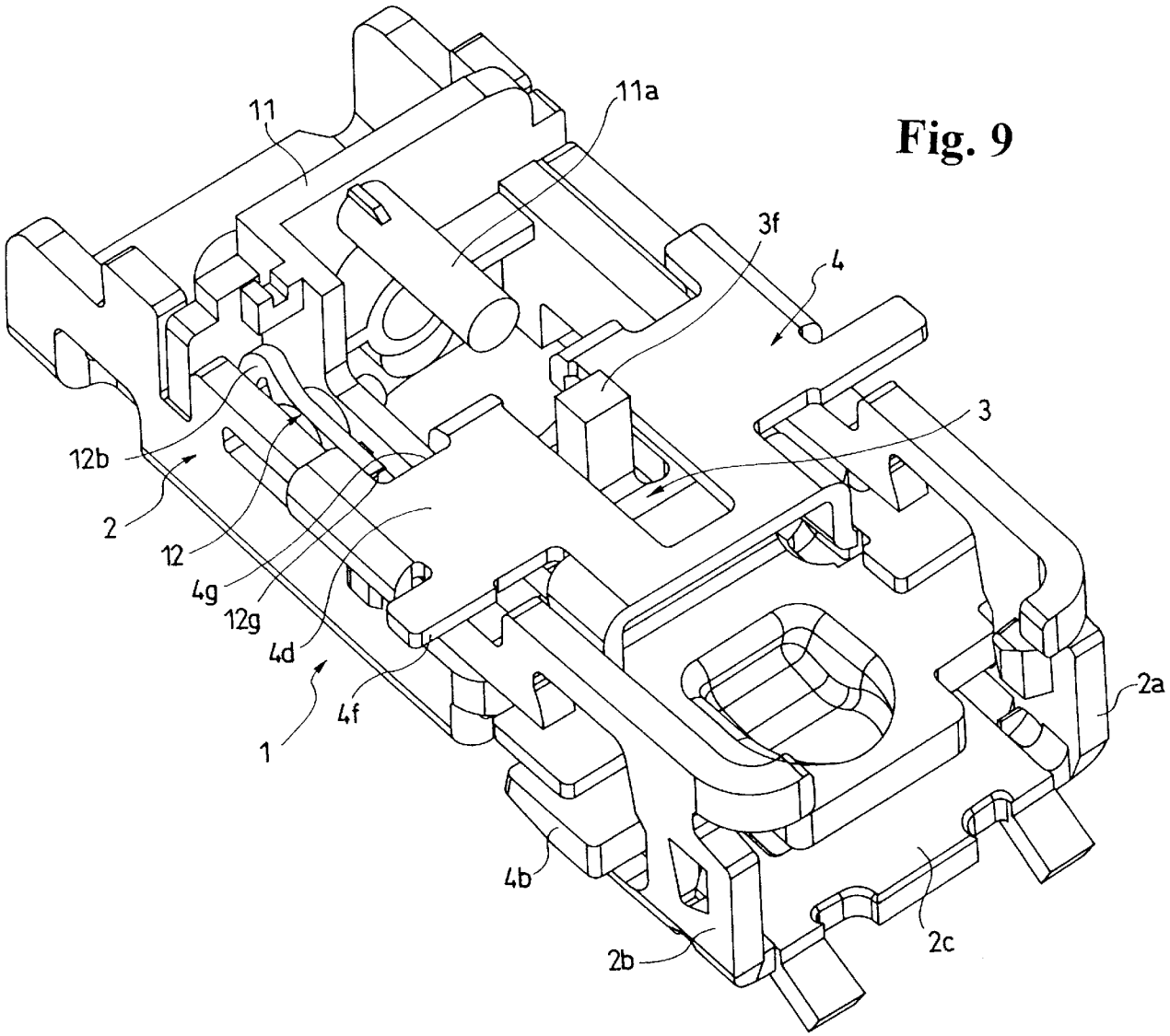
FIG. 9 is a perspective view of the buckle of the embodiment shown in FIGS. 1(*a*), 1(*b*) in a state where an inhibiting means employed in the buckle is in its non-restricting position.

As shown in FIGS. 8(*a*), 8(*b*), and 8(*c*), the ejector 6 comprises a tongue press portion 6*a* which is disposed on the bottom 2*c* of the base 2 so that the tongue press portion 6*a* can slide along the elongated opening 2*h* formed in the bottom 2*c* (clearly shown in FIG. 1(*b*) and FIG. 2) to press the end of the tongue 10, lock slider press portions 6*b*, 6*b* which press the ejector-contact portion 4*e*, 4*e* of the lock slider 4, a holding portion 6*c* which holds the latch member 3 in the non-engaged position by the contact with the joggle portion 3*c* when the latch member 3 is in the non-engaged position (shown in FIG. 1(*b*)), a spring supporting portion 6*d* which is composed of a hole in which the other end of the ejector spring 9 is accommodated and thus supported, and an inclined guide surface 6*e* which is able to be in contact with the lower surface of the joggle portion 3*c* to guide the joggle portion 3*c* to move upwardly according to the rightward movement of the ejector 6.

That is, the ejector 6 is always biased by the spring force of the ejector spring 9 in a direction of ejecting the tongue 10 from the buckle 1. When the tongue 10 is not inserted, the ejector 6 is in contact with the end (right side end) of the elongated hole 2*h* from which the tongue 10 is inserted as shown in FIG. 1(*b*).

Figure 10:
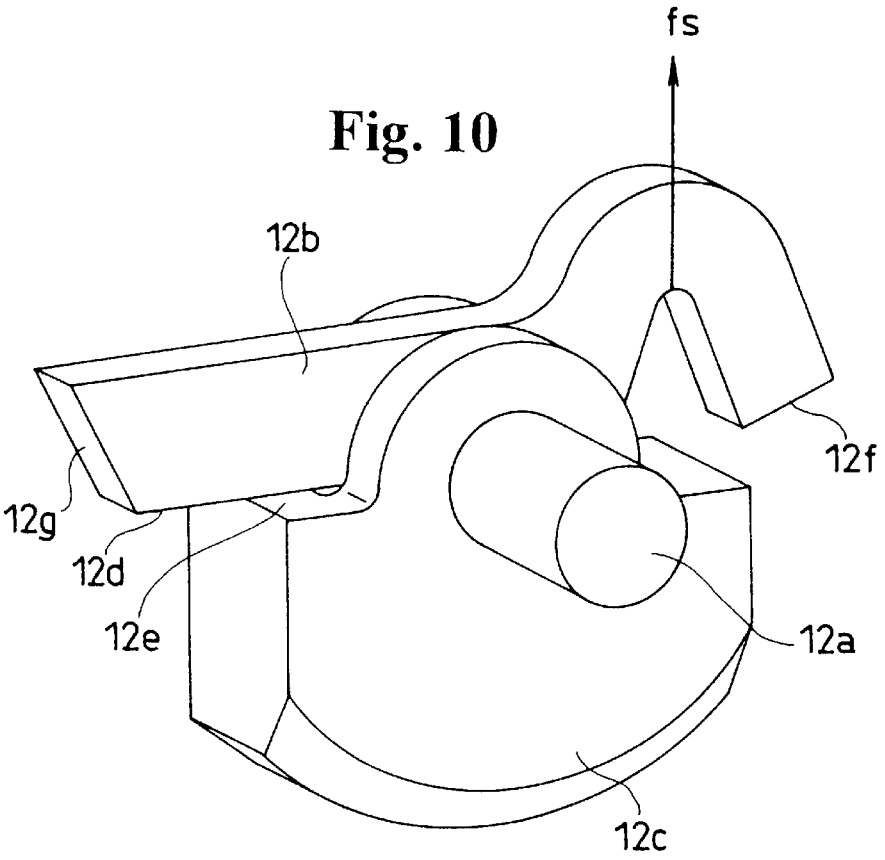
FIG. 10 is a perspective view showing a lever and a mass body of the inhibiting means shown in FIG. 9.

In addition, the buckle 1 of this embodiment is provided with an inhibiting means 12 rotatably disposed between the side wall 2*b* of the base 2 and the supporting wall 11*d*, which prevents the lock slider 4, which locks the latch member 3 in the engaged position, from moving to the disengaged position in the event of occurrence of extreme acceleration during the buckle 1 and the tongue 10 are engaged. As shown in FIG. 10, the inhibiting means 12 comprises a rotation shaft 12*a* hung and supported between the side wall 2*b* and the supporting wall 11*d*, a lever 12*b* rotatably supported by the rotational shaft 12*a*, the lever 12*b* composing a first inertial body, and a mass body 12*c* rotatably supported by the rotational shaft 12*a*, the mass body 12*c* composing a second inertial body of which mass is different from that of the first inertial body.

The inhibiting means 12 is disposed so that the mass body 12*c* is positioned between the first and second stoppers 2*q*, 2*r*. The lever 12*b* and the mass body 12*c* can rotate about the rotation shaft 12*a*, allowing the relative rotation therebetween. In this case, the center of gravity $G_1$ of the lever 12*b* is always positioned above the rotational shaft 12*a* and the center of gravity $G_2$ of the mass body 12*c* is always positioned beneath the rotational shaft 12*a*. Therefore, as shown in FIGS. 11(*a*) and 11(*c*), inertia force $F_1$ or $F_2$ acting on the inhibiting means 12 always causes torque $T_1$, $T_2$ or $T_1'$, $T_2'$ of which directions are opposite to each other, on the lever 12*b* and the mass body 12*c*.

A part of the lower surface 12*d* of the lever 12*b* can come in contact with the lever-contact surface 12*e* of the mass body 12*c*. The part of the lower surface 12*d* and the lever-contact surface 12*e* function as torque transmitting surfaces for transmitting torque from and to each other. The other part of the lower surface 12*d* of the lever 12*b* can come in contact with the upper surface of the second stopper 2*r*. One of ends of the lever 12*b* is capable of coming in contact with the upper surface of the first stopper 2*q*. The other end of the lever 12*b* can come in contact with the lever-contact portion 4*g* of the main body 4*d* of the lock slider 4 and thus functions as a limit end 12*g* stopping the movement of the lock slider 4. The lever 12*b* is always biased in the counter-clockwise direction by the spring force $f_s$ of the spring (not shown). A spring of any type which can bias the lever 12*b* to rotate in the counter-clockwise direction may be employed as this spring.

Figure 11A:
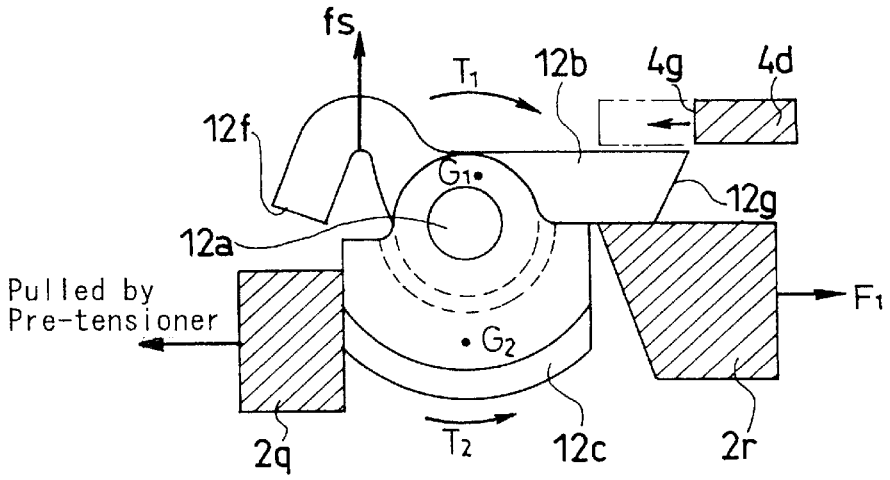
FIGS. 11(*a*) through 11(*c*) are views for explaining the operation of the inhibiting means shown in FIG. 9, FIG. 11(*a*) is a view showing its normal state, FIG. 11(*b*) is a view showing a state during operation of pulling the buckle by a pre-tensioner, and FIG. 11(*c*) is a view showing a state at the terminal of the operation of pulling the buckle by the pretensioner.
Figure 11B:
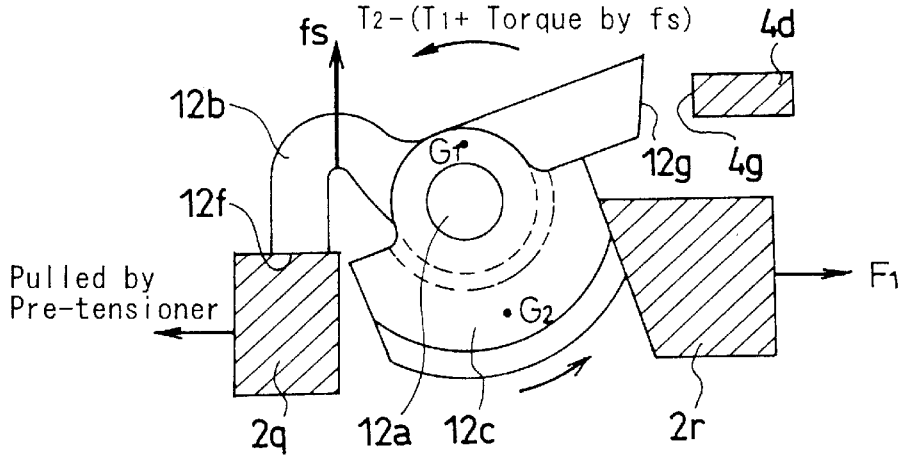
Figure 11C:
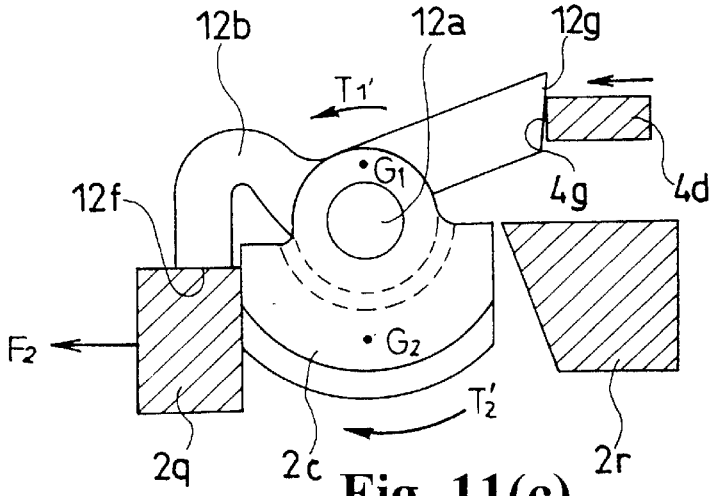
Figure 13:
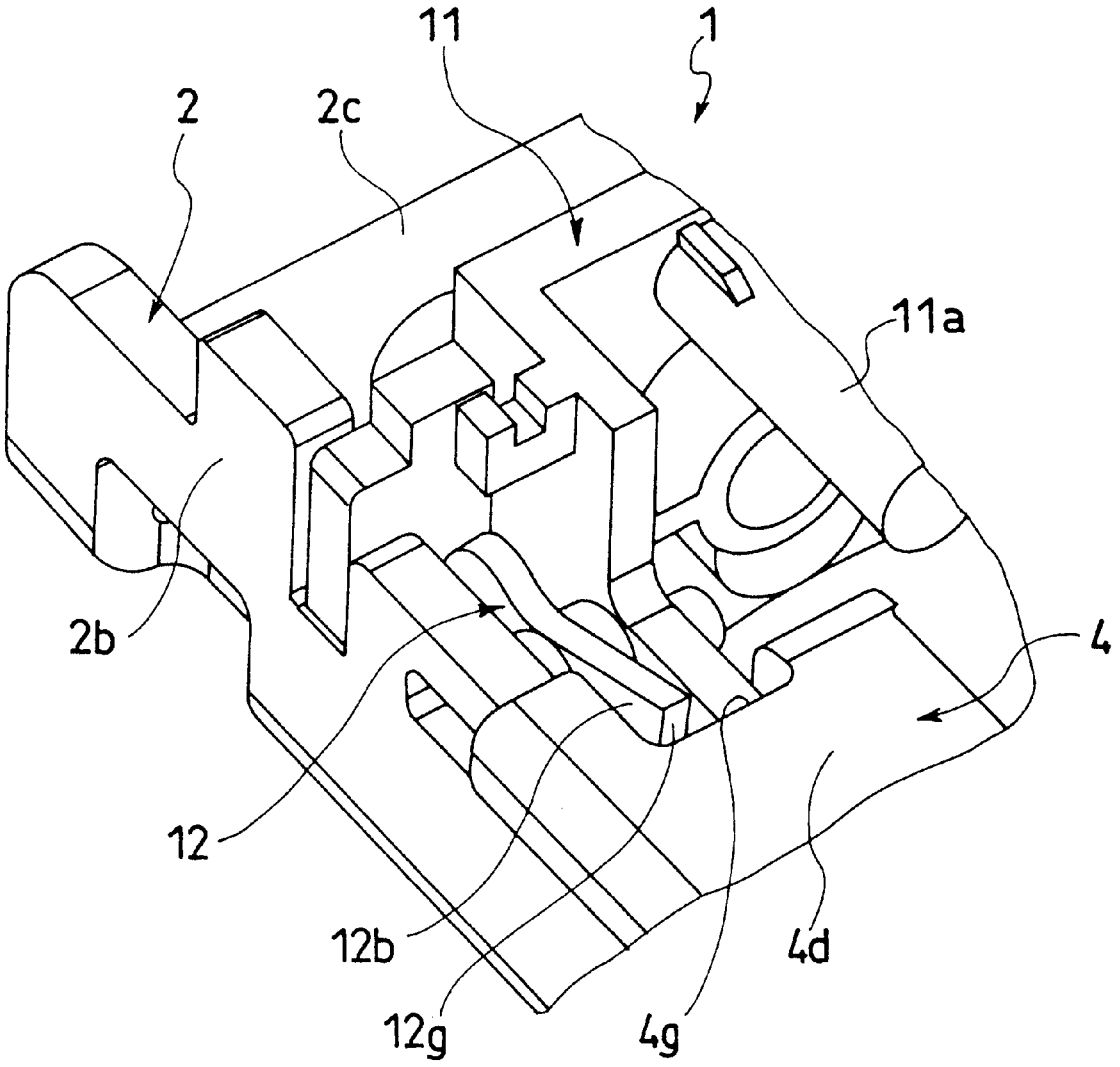
FIG. 13 is a partial perspective view showing the buckle in a state where the inhibiting means in its restricting position.

As shown in FIG. 11(*a*), during the lower surface 12*d* of the lever 12*b* comes in contact with the upper surface of the second stopper 2*r*, the inhibiting means is set in the non-restricting position where the lever-contact portion 4*g* of the main body 4*d* does not come in contact with the limit end 12*f* of the lever 12*b* so that the main body 4*d* of the lock slider 4 is allowed to move as shown in double-dashed lines. In the non-restricting position, the torque transmitting surfaces of the lever 12*b* and the mass body 12*c* are in contact with each other and the left end of the mass body 12*c* is in contact with the first stopper 2*q*. Normally, the lever 12*b* and the mass body 12*c* are set in the state shown in FIG. 11(*a*) because of the spring force $f_s$ of the spring and are thus prevented from rotating in the clockwise direction.

Hereinafter, the operation of the buckle 1 of this embodiment will be described. In the non-engaged state of the buckle 1 shown in FIG. 1(*b*), the supporting/restraining portions 4*a*, 4*b* of the lock slider 4 are positioned beneath the shoulders 3*a*, 3*b* of the latch member 3 and the lower surface of the joggle portion 3*c* is held by the holding portion 6*c* of the ejector 6. The inhibiting means 12 is in the state shown in FIG. 11(*a*). That is, the lower surface 12*d* of the lever 12*b* is in contact with the upper surface of the second stopper 2*r*, so the lever 12 is set in the non-restricting position and the torque transmitting surfaces of the lever 12*b* and the mass body 12*c* are in contact with each other. Furthermore, the left end of the mass body 12*c* is in contact with the side of the first stopper 2*q*.

In this state, as the tongue 10 is inserted in the buckle 1 from the right side, the end of the tongue 10 comes in contact with the tongue press portion 6*a* of the ejector 6, so the ejector 6 is pressed by the tongue 10 to move leftward. As the lower surface of the joggle portion 3*c* is displaced from the holding portion 6*c* of the ejector 6, the latch member 3 tends to rotate in the clockwise direction about the shafts 3*a*, 3*b* because the spring force of the button spring 8 is transmitted from the latch member press portion 5*d* to the pressed portion 3*f*. Since the shoulder portions 3*d*, 3*e* are supported by the supporting/restraining portions 4*a*, 4*b*, the latch member 3 is however prevented from rotating in the clockwise direction. Therefore, the joggle portion 3*c* of the latch member 3 is prevented from entering into the passage for the tongue 10 so as to secure the passage for the tongue 10, whereby the tongue 10 is smoothly inserted.

As the tongue 10 is further inserted into the buckle 10, the ejector 6 also further moves leftward so that the slider press portions 6*b*, 6*b* comes in contact with the ejector-contact portions 4*e*, 4*e* of the lock slider 4. At this point, the latch end 10*b* (the left end of the latch hole 10*a*) of the latch hole 10*a* of the tongue 10 is slightly on the left side of the latch end 3*c* (left end) of the joggle portion 3*c* of the latch member 3.

As the tongue 10 is further inserted, the lock slider 4 moves leftward as well as the ejector 6. At this point, since the lower surface 12*d* of the lever 12*b* of the inhibiting means 12 is in contact with the upper surface of the second stopper 2*r* as shown in FIG. 11(*a*), the lock slider 4 moves leftward without any trouble. The leftward movement of the lock slider 4 displaces the supporting/restraining portions 4*a*, 4*b* from the shoulder portions 3*d*, 3*e* so that the supporting/restraining portions 4*a*, 4*b* are positioned to confront the concave portions 3*g*, 3*h*. At this point, the central portion of the latch hole 10*a* is positioned right beneath the joggle portion 3*c*. As the supporting/restraining portions 4*a*, 4*b* are displaced from the shoulder portions 3*d*, 3*e*, the latch member 3 rotates about the shafts 3*a*, 3*b* in the clockwise direction because it is biased by the spring force of the button spring 8 as mentioned above. Therefore, the joggle portion 3*c* of the latch member 3 completely enters into substantially the central portion of the latch hole 10*a*, i.e. becomes in the engaged position and the upper surfaces of the shoulder portions 3*d*, 3*e* are positioned slightly lower than the lower surfaces of the supporting/restraining portions 4*a*, 4*b*.

As the force of inserting is cancelled by releasing the tongue 10 in this state, the ejector 6 and the tongue 10 move rightward by the spring force of the ejector spring 9 so that the latch end 10*b* of the latch hole 10*a* of the tongue 10 comes in contact with the latch end 3*c* of the joggle portion 3*c* of the latch member 3. In this way, the tongue 10 is latched to the latch member 3. At the same time, the lock slider 4 moves rightward because of the spring force of the slider spring 7 so that the supporting/restraining portions 4*a*, 4*b* are positioned right above the shoulder portions 3*d*, 3*e* with a slight distance between the supporting/restraining portions 4*a*, 4*b* and the shoulder portions 3*d*, 3*e*. As a result of this, even when a large impact is applied e.g. in the event of a vehicle collision, the shoulder portions 3*d*, 3*e* are in contact with and restricted by the supporting/restraining portion 4*a*, 4*b* whereby the latch member 3 is restrained from pivoting in the counter-clockwise direction and is held in the engaged position by the supporting/restraining portions 4*a*, 4*b*. As a result, the buckle 1 and the tongue 10 are securely prevented from releasing from each other even in the event of large impact. In this way, the buckle 1 and the tongue 10 become in the engaged state shown in FIG. 2. In the engaged state where the buckle 1 and the tongue 10 are engaged, the slider press portions 5*f*, 5*g* are spaced apart from the pressed portion 4*f* of the main body 4*d* of the lock slider 4 by release play a (shown in FIG. 6(*b*)).

For releasing the tongue 10 from the buckle 1 from the engaged state where the buckle 1 and the tongue 10 are engaged as shown in FIG. 2, the operational portion 5*a* of the first operational piece 5A is pressed leftward. Then, the first and second operational pieces 5A, 5B move just for the release play a so that the latch member press portion 5*d* of the operational button 5 moves apart from the pressed portion 3*f* of the latch member 3 and the slider press portions 5*f*, 5*g* come in contact with the pressed portion 4*f* of the main body 4*d* of the lock slider 4.

As the operational pieces 5A, 5B are further pressed, the slider press portions 5*f*, 5*g* of the operational button 5 press the lock slider 4 to move leftward along the longitudinal direction of the buckle 1 until the supporting/restraining portions 4*a*, 4*b* come to the concave portions 3*g*, 3*h* of the latch member 3 and a slight clearance is created between the supporting/restraining portions 4*a*, 4*b* and the shoulder portions 3*d*, 3*e*. As a result of this, the latch member 3 is allowed to pivot about the shafts 3*a*, 3*b* in the counter-clockwise direction. Since the ejector 6 is biased by the spring force of the ejector spring 9 in the direction of releasing the tongue, the ejector 6 pushes out the tongue 10 rightward and, at the same time, pushes up the latch member 3 so that the latch member 3 pivots about the shafts 3*a*, 3*b* in the counter-clockwise direction and the joggle portion 3*c* escapes from the latch hole 10*a* of the tongue 10.

Therefore, the ejector 6 moves further rightward to push out the tongue 10 and, at the same time, the lower surface of the joggle portion 3*c* comes in contact with the inclined guide surface 6*e* of the ejector 6 so that the latch member 3 pivots in the counter-clockwise direction according to the rightward movement of the ejector 6. When the lower surface of the joggle portion 3*c* reaches the holding portion 6*c* of the ejector 6, the latch member 3 is stopped from pivoting in the counter-clockwise direction. In this state, the lower surfaces of the shoulder portions 3*d*, 3*e* of the latch member 3 are positioned slightly above the upper surfaces of the supporting/restraining portions 4*a*, 4*b* of the lock slider 4.

As the first operational piece 5A is released from the finger, the first and second operational pieces 5A, 5B move to the inoperative position because of the spring force of the button spring 8 and the latch member press portion 5*d* comes in contact with the pressed portion 3*f* of the latch member 3 to bias the latch member 3 in the clockwise direction as mentioned above. At the same time, the lock slider 4 moves to the right because of the spring force of the slider spring 7 so that the supporting/restraining portions 4*a*, 4*b* enter into spaces right beneath the shoulder portions 3*d*, 3*e* and the ejector 6 returns to the inoperative position. The joggle portion 3*c* is held by the holding portion 6*c* of the ejector 6.

In this manner, the buckle 1 and the tongue 10 are completely disengaged so that the buckle 1 becomes in the non-engaged state shown in FIG. 1(*b*).

As mentioned above, in the buckle 1 of this embodiment, the lock slider 4 moves only linearly in the longitudinal direction, making the movement of the lock slider 4 significantly simple and smooth. This improves the controllability of the latch member 3.

By the way, as the pretensioner (not shown) is actuated for some reason when the buckle 1 and the tongue 10 are engaged, the buckle 1 is suddenly pulled to the left in FIG. 11(*a*). During a period between the start of the actuation of the pre-tensioner and a time just before the bottoming i.e. the termination of the actuation of the pre-tensioner, the buckle 1 is subjected to extreme acceleration G within a range I shown in FIG. 12. The acceleration G causes large inertia force $F_1$ on the buckle 1, of which direction is opposite to the direction of the acceleration. And the inertia force $F_1$ causes clockwise torque $T_1$ on the lever 12*b* and counter-clockwise torque $T_2$ on the mass body 12*c*. As shown in FIG. 11(*b*), the mass body 12*c* rotates in the counter-clockwise direction and transmits the torque to the lever 12*b*. Since the torque $T_2$ of the mass body 12*c* of the mass body 12*c* becomes larger than the total of the torque $T_1$ of the lever 12*b* produced by the inertia force and the torque produced by the spring force $f_s$ of the spring, the mass body 12*c* rotates the lever 12*b* in the counter-clockwise direction. The rotation of the lever 12*b* and the mass body 12*c* is stopped when the end 12*f* of the lever 12*b* comes in contact with the upper surface of the first stopper 2*q* and the right end of the mass body 12*c* comes in contact with the side of the second stopper 2*r*. In this state, the limit end 12*g* of the lever 12*b* is positioned in the restraining position on the passage for the main body 4*d* of the lock slider 4. Because of the inertia force $F_1$ acting on the buckle 1, the lock slider 4 tends to move to the right i.e. in the direction of preventing the disengagement between the latch member 3 and the tongue 10. Since the lock slider 4 is, however, restricted in the position shown in FIG. 2, the lock slider 4 is held in the position not to move to the right. Therefore, the engagement between the latch member 3 and the tongue 10 is securely kept in this case.

Figure 12:
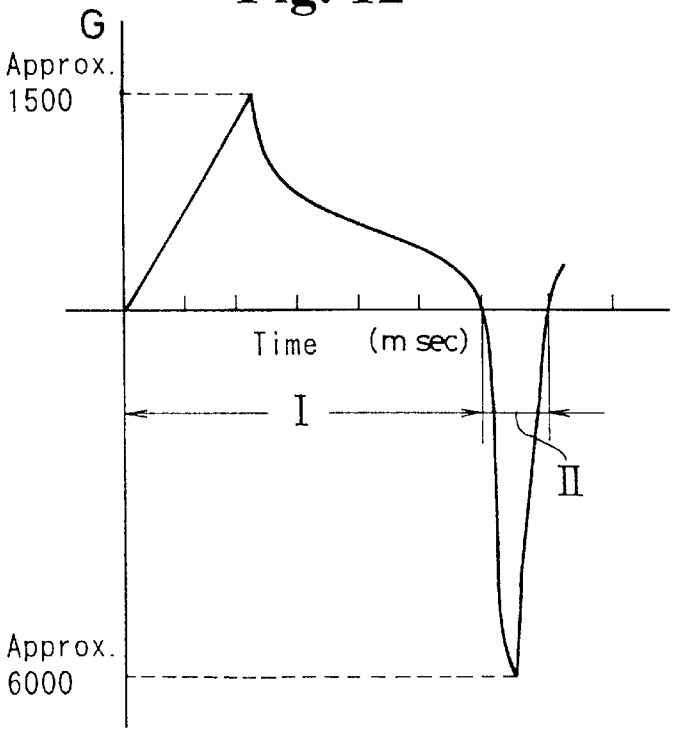
FIG. 12 is a diagram showing acceleration exerted on the buckle during the operation of pulling the buckle by the pre-tensioner.

As the pre-tensioner bottoms, extreme acceleration G within the range II shown in FIG. 12 acting in the opposite direction is exerted on the buckle 1. The acceleration G causes inertia force $F_2$ acting on the buckle 1, the direction of the inertia force $F_2$ being opposite to the direction of the aforementioned inertia force $F_1$ as shown in FIG. 11(*c*). The inertia force $F_2$ causes counter-clockwise torque $T_1'$ on the lever 12*b* and clockwise torque $T_2'$ on the mass body 12*c*. Thus, the mass body 12*c* rotates in the clockwise direction. Since the mass body 12*c* can rotate relative to the lever 12*b*, only the mass body 12*c* rotates in the clockwise direction, the torque transmitting surfaces are spaced apart from each other so that the torque is not transmitted between the lever 12*b* and the mass body 12*c*. That is, the lever 12*b* is not effected by the rotation of the mass body 12*c*. Since the torque is not transmitted to the lever 12*b* from the mass body 12*c*, the lever 12*b* is biased by the torque $T_1'$ in the counter-clockwise direction against the spring force $f_s$ of the spring. However, since the end 12*f* of the lever 12*b* is already in contact with the upper surface of the first stopper 2*q*, the lever 12*b* does not rotate at all so that the limit end 12*g* is held in the restricting position.

Because of the inertia force $F_2$ acting on the buckle 1, the lock slider 4 moves to the left in the direction causing the disengagement between the latch member 3 and the tongue 10. However, the lever-contact portion 4*g* of the main body 4*d* of the lock slider 4 comes in contact with the limit end 12*g* of the lever 12*b*, thereby preventing the leftward movement of the lock slider 4. In this state, the lock slider 4 does still not reach the position where the latch member 3 and the tongue 10 are disengaged and the supporting/restraining portions 4*a*, 4*b* are held in the position where the shoulder portions 3*d*, 3*e* are restrained. Therefore, even when inertia force is exerted on the lock member 4 in the direction causing the disengagement between the latch member 3 and the tongue 10 when the pre-tensioner bottoms, the engagement between the latch member 3 and the tongue 10 is securely held.

As mentioned above, even when extreme acceleration is exerted on the buckle 1 in the state where the buckle 1 and the tongue 10 are engaged, the inhibiting means 12 of the buckle 1 of this embodiment can securely prevent the unexpected disengagement between the buckle 1 and the tongue 10. In addition, even when the direction of the inertia force acting on the buckle 1 is suddenly changed from the direction opposite to the direction toward the releasing position of the lock slider 4 to the direction toward the releasing position of the lock-slider 4, the movement of the lock slider 4 toward the releasing position of the lock slider 4 is securely prevented. Therefore, even when the direction of the inertia force is suddenly changed, the unexpected disengagement between the buckle 1 and the tongue 10 can be securely prevented.

Since the inhibiting means 12 restricts the movement of the lock slider 4, the prevention of the disengagement can be secured. Moreover, the movement of the first and second operational pieces 5A, 5B is not restricted and the movement of the lock slider 4 is, normally, not restricted, thereby improving the operational feeling of the first and second operational pieces 5A, 5B. The first and second operational pieces 5A, 5B are not required to be formed with a special part, thereby providing interchangeability to the first and second operational pieces 5A, 5B. The inhibiting means 12 and the related components are not required to be assembled with quite high accuracy, thereby improving the assembly condition of the parts including the operational button.

Though the above description of the operation of the buckle 1 was made as regard to two inertia forces acting on the buckle 1 which are the inertia force developed at the actuation of the pre-tensioner and the inertia force developed at the bottoming of the pre-tensioner, the same is true for any inertia force acting on the buckle 1 by other causes such as inertia force due to the acceleration or deceleration exceeding the predetermined value.

As apparent from the above description, the buckle of the present invention can securely prevent the lock member to moving toward the position allowing the disengagement when inertia force is exerted in such a manner as to move the lock member toward the position allowing the disengagement, thereby securely preventing unexpected disengagement between the buckle and the tongue.

Even when the direction of the inertia force acting on the buckle is suddenly changed from the direction opposite to the direction toward the position allowing the disengagement to the direction allowing the disengagement, the lock member can be prevented from moving toward the position allowing the disengagement. Therefore, the unexpected disengagement between the buckle and the tongue can be securely prevented.

Since the movement of the operational member is not restricted by the inhibiting means, the operational feeling of the operational member is still well even with the inhibiting means. The operational member is not formed with a special part, thereby providing interchangeability to the operational member. The inhibiting means and the related components are not required to be assembled with quite high accuracy, thereby improving the assembly condition of the parts including the operational button.

In addition, according to the present invention, the movement of the operational member is restricted by the inhibiting means but, normally, the operational member is not restricted at all.

What we claim is:

1. A buckle comprising: a base having side walls; a latch member which is supported by the side walls so that the latch member can pivot between its non-engaged position and its engaged position, is biased to said engaged position, and pivots to the engaged position, when a tongue is inserted into a predetermined position, so as to engage the tongue; an operational member for canceling the engagement between said tongue and said latch member; and a lock member which holds said latch member to said engaged position when said tongue and said latch member are engaged with each other and is able to be moved by said operational member to a position allowing the disengagement between said tongue and said latch member;

further comprising an inhibiting means for preventing the movement of said lock member toward said position allowing the disengagement not caused by the releasing action of said operational member, wherein said inhibiting means has first and second inertia bodies of which masses are different from each other and which can rotate about a common shaft allowing relative rotation and are subjected to respective torque acting in directions opposite to each other when external force is exerted on the buckle; wherein said first inertia body can rotate between a restricting position preventing the movement of the lock member toward said position allowing the disengagement not caused by the releasing action of said operational member and a non-restricting position allowing the movement of said lock member toward said position allowing the disengagement, and is normally set in the non-restricting position and is designed such that torque is developed to rotate the first inertia body in a direction from the non-restricting position to the restricting position when inertia force causing the movement of said lock member toward said position allowing the disengagement is exerted, and said second inertia body, at least, rotates from an original position to the position where the first inertia body is set in the restricting position when inertia force exceeding a predetermined value acts in a direction opposite to a travel direction of said lock member toward said position allowing the disengagement, and then rotates toward the original position when inertia force acts in the travel direction of said lock member toward said position allowing the disengagement.

2. The buckle as claimed in claim 1, wherein said lock member is arranged to be allowed to move only in a longitudinal direction of said buckle.

3. A buckle comprising: a base having side walls; a latch member which is supported by the side walls so that the latch member can pivot between its non-engaged position and its engaged position, is biased to said engaged position, and pivots to the engaged position, when a tongue is inserted into a predetermined position, so as to engage the tongue; and an operational member capable of moving to a disengagement position where the engagement between said tongue and said latch member is canceled;

further comprising an inhibiting means for preventing the movement toward a disengagement position not caused by the releasing action of said operational member, wherein said inhibiting means has first and second inertia bodies of which masses are different from each other and which can rotate about a common shaft allowing relative rotation and are subjected to respective torque acting in directions opposite to each other when external force is exerted on the buckle; wherein said first inertia body can rotate between a restricting position preventing the movement toward said disengagement position not caused by the releasing action of said operational member and a non-restricting position allowing the movement toward said disengagement position, and is normally set in the non-restricting position and is designed such that torque in a direction from the non-restricting position to the restricting position is developed when inertia force causing the movement of said lock member toward said disengagement position is exerted, and said second inertia body, at least, rotates from an original position to the position where the first inertia body is set in the restricting position when inertia force exceeding a predetermined value acts in a direction opposite to a travel direction of said operational member toward said disengagement position, and rotate toward the original position when inertia force acts in the travel direction of said operational member toward said disengagement position.

* * * * *